US011137192B2

(12) United States Patent
Lee

(10) Patent No.: US 11,137,192 B2
(45) Date of Patent: Oct. 5, 2021

(54) CIRCULATOR FOR COOLING MAT

(71) Applicant: Hyun-Jung Lee, Seoul (KR)

(72) Inventor: Hyun-Jung Lee, Seoul (KR)

( * ) Notice: Subject to any disclaimer, the term of this patent is extended or adjusted under 35 U.S.C. 154(b) by 220 days.

(21) Appl. No.: 16/552,572

(22) Filed: Aug. 27, 2019

(65) Prior Publication Data

US 2020/0224952 A1 Jul. 16, 2020

(30) Foreign Application Priority Data

Jan. 11, 2019 (KR) ..... 20-2019-0000154

(51) Int. Cl.

| | |
|---|---|
| ***F25D 17/02*** | (2006.01) |
| ***F25D 31/00*** | (2006.01) |
| ***F25D 19/00*** | (2006.01) |
| ***A47C 21/04*** | (2006.01) |

(52) U.S. Cl.

CPC ..... *F25D 17/02* (2013.01); *A47C 21/044* (2013.01); *F25D 19/006* (2013.01); *F25D 31/002* (2013.01)

(58) Field of Classification Search

CPC ..... F25D 17/02; F25D 19/006; F25D 31/002; F25D 15/00; F25D 3/02; A47C 21/044

See application file for complete search history.

(56) References Cited

U.S. PATENT DOCUMENTS 5,306,121 A * 4/1994 Heflin ..... F04B 39/0044 248/638

FOREIGN PATENT DOCUMENTS

| | | | | |
|---|---|---|---|---|
| KR | 20-0217039 B1 | | 3/2001 | |
| KR | 100770093 B1 | * | 10/2007 | |
| KR | 10-1250880 B1 | | 4/2013 | |
| KR | 10-1851894 B1 | | 4/2018 | |
| WO | WO-2017030375 A1 | * | 2/2017 | ..... A47C 21/04 |

* cited by examiner

*Primary Examiner* — Joseph F Trpisovsky

(74) *Attorney, Agent, or Firm* — Studebaker & Brackett PC

(57) ABSTRACT

A circulator for a cooling mat, whereby water is brought into contact with a frozen refrigerant, cooled thereby, and then circulated through a pipe of the mat. A cooling effect can be provided to a user in contact with the mat by using the circulator having a simple structure.

7 Claims, 7 Drawing Sheets

CIRCULATOR FOR COOLING MAT

CROSS REFERENCE TO RELATED APPLICATION

The present application claims priority to Korean Patent Application No. 20-2019-0000154, filed Jan. 11, 2019, the entire contents of which is incorporated herein for all purposes by this reference.

RELATED ART

Field of the Invention

The present invention relates to a circulator for a cooling mat, whereby water is brought into contact with a frozen refrigerant, cooled thereby, and then circulated through a pipe of the mat, such that a cooling effect can be provided to a user in contact with the mat by using the circulator having a simple structure.

Description of the Related Art

Mats which are used on a floor in a living room or on a bed in a bedroom are becoming popular. In recent years, particularly, a mat which provides a heating or cooling effect to a user of the mat by placing a serpentine hose or pipe in the mat and circulating hot water or cold water through the hose or pipe has become popular.

In the case of a hot water mat, water is heated and circulated by the use of an electric heating method. In the case of a cold water mat, circulating water is cooled by the use of a coolant such as ice. Regarding such a cold water mat, a method as disclosed in Korean Utility Model Registration No. 20-0217039 is mainly used in the related art, in which ice and water are contained and stored in a container, and the water cooled by the ice is circulated in such a manner that the water is introduced into a tube of a mat along a feed line by the operation of a circulation pump. This method is characterized in that ice, which is a refrigerant, and circulating water are placed in one space for mixing.

Since then, an improvement has been made over this, and a method of separating and isolating a refrigerant and circulating cooling water has been developed. According to Korean Patent No. 10-1250880, there is disclosed a method in which a separate ice container is provided in a water container such that water in the water container and ice in the ice container are isolated from each other, whereby when the ice melts, a user only removes the ice container, places the ice container in a freezer compartment for re-cooling, and places back the ice container in the water container for use.

However, a known disadvantage of such a refrigerant and circulating water isolating method is that heat exchange efficiency between the refrigerant and the circulating water is relatively reduced due to a local contact area. This reduction in the heat exchange efficiency inhibits rapid cooling of the circulating water, which inevitably results in that a sufficient cooling effect can not be transferred to a user. Accordingly, there is a need for a circulator for a cooling mat for increasing heat exchange efficiency by increasing contact area and time for facilitating heat exchange between refrigerant and circulating water, while exhibiting a rapid and uniform cooling performance.

The foregoing is intended merely to aid in the understanding of the background of the present invention, and is not intended to mean that the present invention falls within the purview of the related art that is already known to those skilled in the art.

SUMMARY

Accordingly, the present invention has been made keeping in mind the above problems occurring in the related art, and an objective of the present invention is to provide a circulator for a cooling mat, the circulator having an increased heat exchange performance and a more rapid and uniform cooling performance.

Another objective of the present invention is to provide a circulator for a cooling mat, the circulator realizing rapid cooling of cooling water by maximizing the length a flow path of cooling water and a contact area with a refrigerant.

In order to achieve the above objectives, according to one aspect of the present invention, there is provided a circulator for a cooling mat, the circulator including: a main body including a cooling part having a structure for cooling a fluid by heat exchange, and a circulation part located under the cooling part and having a structure for circulating the fluid; a lid covering an upper end opening of the cooling part of the main body; a refrigerant container located inside the cooling part and accommodating a refrigerant therein; a recovery pipe recovering the fluid after the fluid is brought into contact with the refrigerant container; a motor disposed inside the circulation part to circulate the fluid that is introduced from the recovery pipe; a discharge pipe discharging the cooled fluid to the cooling mat; and an inlet pipe into which the fluid to be returned after circulation inside the cooling mat is introduced, wherein the fluid introduced into the cooling part from the inlet pipe flows in contact with the refrigerant container located inside the cooling part.

The motor may be supported by an elastic buffer member made of an elastic material and provided inside the circulation part.

A central riser pipe extending upward may be centrally disposed inside the cooling part, and a vertical hole may be formed in the central riser pipe in communication with the inlet pipe, such that the fluid introduced into the inlet pipe is pumped up to an upper end of the central riser pipe along the vertical hole.

The refrigerant container located inside the cooling part may be provided as multiple refrigerant containers, and the refrigerant containers may be arranged outside a circumference of the central riser pipe in close contact therewith, such that heat exchange occurs between the fluid pumped up along the vertical hole of the central riser pipe and the refrigerant accommodated in the refrigerant containers.

The central riser pipe may include separation ribs extending laterally therefrom at a regular interval to separate a space, and the refrigerant containers may be arranged outside the circumference of the central riser pipe in close contact therewith, with predetermined gaps defined between the refrigerant containers by the separation ribs.

A distributor may be provided at the upper end of the central riser pipe, and the distributor may include: a lower hole communicating with the vertical hole of the central riser pipe; and a distribution hole formed laterally outwardly to radially discharge the fluid introduced through the lower hole to outside the distributor.

The distribution hole of the distributor may be provided as multiple distribution holes such that the distribution holes correspond to the respective refrigerant containers arranged outside the circumference of the central riser pipe, and the distribution holes may be oriented toward respective upper surface portions of the refrigerant containers or are formed at positions above the upper surface portions, such that the fluid passing through the distributor falls onto the upper surface portions of the refrigerant containers while being discharged through the distribution holes.

Each of the refrigerant containers may include a cap portion protruding from each of the upper surface portions thereof, and the respective cap portions may be located outside lower ends of the distribution holes, such that the fluid falling from the distribution holes is changed in path by the cap portions while flowing outwardly.

Each of the refrigerant containers may include: an outer surface portion oriented toward an inner wall of the main body located away from the central riser pipe; an inner surface portion facing toward the central riser pipe at a position close thereto; and side surface portions connecting the outer surface portion and the inner surface portion to each other, wherein the fluid changed in the path by each of the cap portions may flow down in contact with at least one of the outer surface portion, the inner surface portion, and the side surface portions.

Multiple grooves and multiple protrusions may be formed horizontally on the at least one of the outer surface portion, the inner surface portion, and the side surface portion.

The present invention having the above-described configuration has an effect of obtaining an increased heat exchange performance and a more rapid and uniform cooling performance.

The present invention has an effect of maximizing the length of a flow path of cooling water and a contact area with a refrigerant.

The present invention has an effect that cooling water can be brought into contact with a refrigerant while flowing down from top to bottom, thus realizing uniform heat exchange along a longer path.

The present invention has an effect that cooling water is pumped up through a pipe placed in a space defined by refrigerant containers to enable the cooling water to be cooled even during an upward flow thereof, thus realizing heat exchange for a longer time.

The present invention has an effect that cooling water discharged onto refrigerant containers flows down along various paths on outer surfaces of the refrigerant containers, thus increasing a contact path and further facilitating heat exchange between the water and refrigerant.

The present invention has an effect of minimizing noises and vibrations by buffering and supporting a motor for cooling water circulation.

BRIEF DESCRIPTION OF DRAWINGS

The above and other objectives, features and other advantages of the present invention will be more clearly understood from the following detailed description when taken in conjunction with the accompanying drawings, in which.

DETAILED DESCRIPTION

Hereinbelow, the configuration and operational effect of the present invention will be described in detail with reference to exemplary embodiments of the present invention shown in the accompanying drawings.

Figure 1:
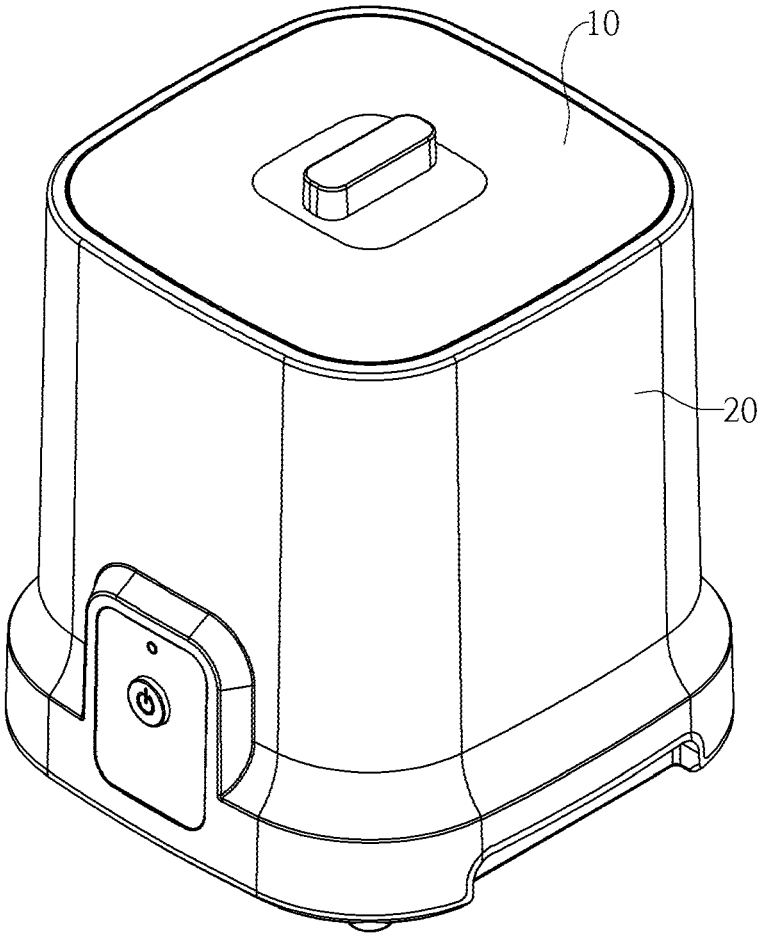
FIG. 1 is a view showing an outer shape of a circulator for a cooling mat according to the present invention.

FIG. 1 is a view showing an outer shape of a circulator for a cooling mat according to the present invention. Referring to FIG. 1, a rectangular parallelepiped-shaped circulator for a cooling mat includes: a main body 20 including a cooling part accommodating cooling water and a refrigerant container therein, and a circulation part located at a position under the cooling part and accommodating a motor; and a lid 10 covering an upper side of the main body 20. When a user operates a power source after lifting the lid 10 and putting the refrigerant container and the cooling water into the main body 20, according to a motor operation of the circulation part, the fluidic cooling water is supplied to a mat (not shown) equipped with a separate pipe in a state of being cooled by the refrigerant container and is circulated for recovery.

Figure 2:
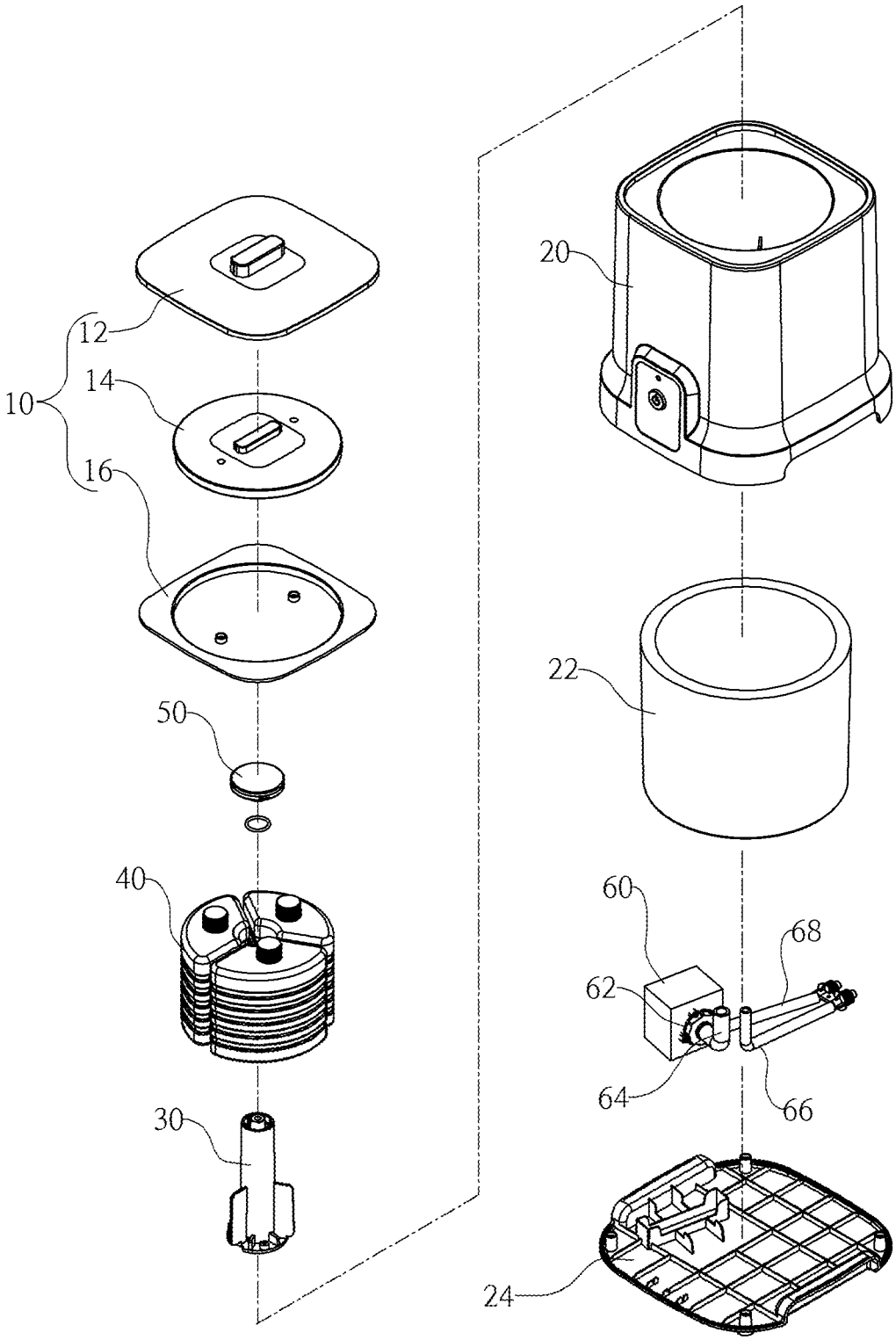
FIG. 2 is an exploded view showing the circulator for the cooling mat according to the present invention.

FIG. 2 is an exploded view showing the circulator for the cooling mat according to the present invention. Referring to FIG. 2, the lid 10 is equipped with a heat insulating material 14 such as Styrofoam between an outer lid 12 and an inner lid 16 and covers the upper side of the cooling part inside the main body 20.

The main body 20 includes the cooling part defined by an upper portion thereof and the circulation part defined by a lower portion, and the cooling part and the circulation part are isolated from each other. The cooling part is where a central riser pipe 30, multiple refrigerant containers 40, and a distributor 50 are seated and coupled, and the circulation part located thereunder is where a motor 62, a recovery pipe 64, an inlet pipe 66, and a buffer member 60 surrounding and supporting the motor 62 are seated. It is preferable that a heat insulating material 22 for preventing condensation is disposed between an inner wall and an outer wall of the main body 20. A bottom member 24 is coupled to a lower side of the circulation part.

The central riser pipe 30 is centrally disposed inside the main body 20 in a vertical direction, and the multiple refrigerant containers 40 are arranged outside the circumference of the central riser pipe 30. Due to such a structure, there is provided an effect that cooling water can be cooled through heat exchange with a refrigerant even while being pumped up through the central riser pipe (upward flow), as well as being flowing down over the refrigerant containers 40 (downward flow). Here, the multiple refrigerant containers 40 arranged outside the circumference of the central riser pipe 30 are configured as small-sized containers, so it is possible for the user to conveniently take out the refrigerant containers 40 for storage in a freezer compartment or put the refrigerant containers 40 back into the main body 20. Moreover, such a structure of the refrigerant containers 40 contributes to increasing the outer surface area of the refrigerant containers 40, leading to an increase in contact area with the cooling water.

Figure 3:
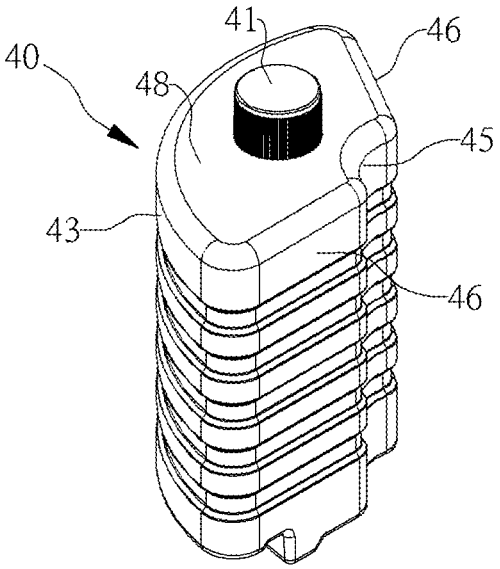
FIGS. 3 to 5 are views showing a refrigerant container according to the present invention, and a state in which a lid of the circulator for the cooling mat is opened when viewed from above.
Figure 4:
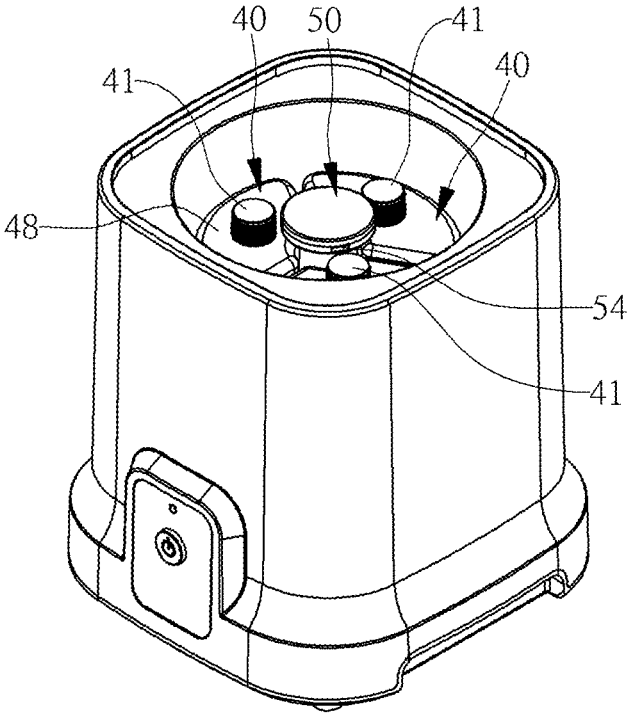
Figure 5:
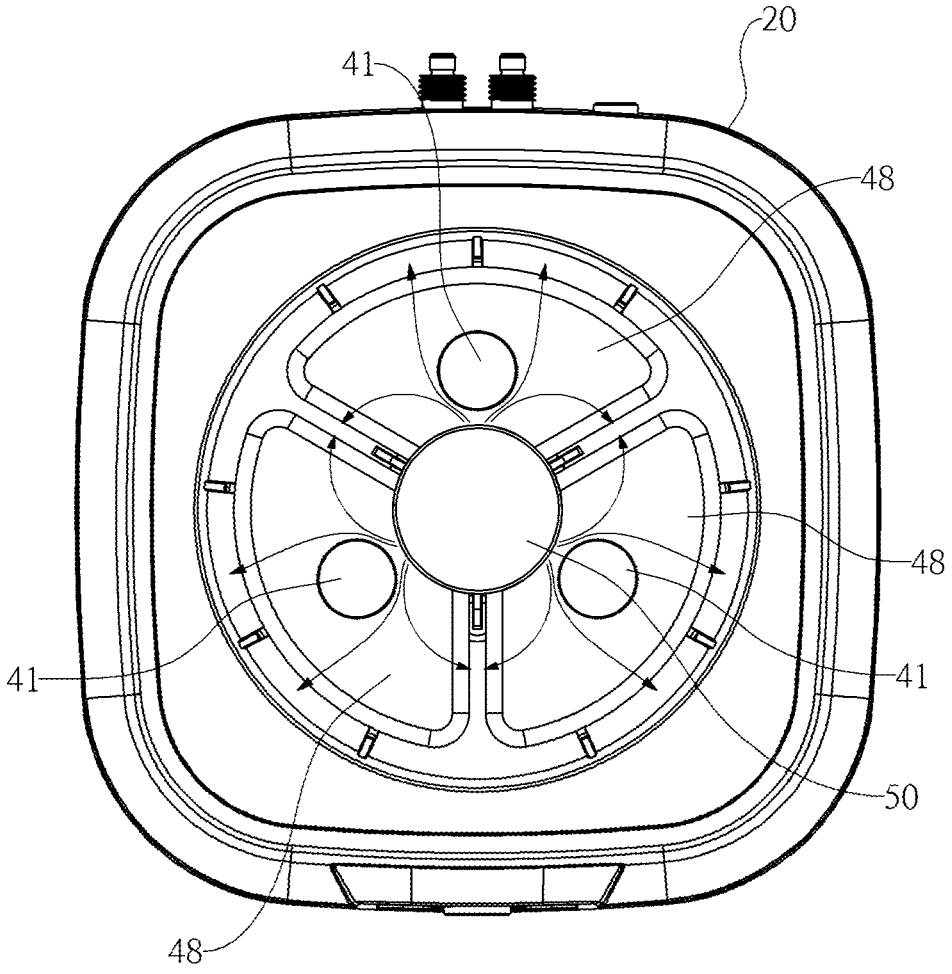

FIGS. 3 to 5 are views showing a refrigerant container according to the present invention, and a state in which a lid of the circulator for the cooling mat is opened when viewed from above. Referring to FIG. 3, the refrigerant containers 40 have an outer shape formed by dividing a cylinder having a vertical through-hole formed therein into three portions, and the refrigerant containers 40 have a hollow shape to accommodate water or other refrigerant therein.

Each of the refrigerant containers 40 includes an inner surface portion 45 facing toward the central riser pipe 30 centrally located inside the main body 20, an outer surface portion 43 oriented outward, side surface portions 46 located opposite to each other and connecting the inner and outer surface portions 45 and 43 to each other, an upper surface portion 48, and a cap portion 41 provided on the upper surface portion 48. The cap portion 41 is configured such that the refrigerant is put into the refrigerant container 40 by opening the cap portion 41. The cap portion 41 protrudes upward from the upper surface portion 48 having a relatively flat shape. The cap portion 41 is rotationally coupled to a threaded portion protruding from the upper surface portion 48.

Referring to FIG. 4, the multiple refrigerant containers 40 are arranged at equal angular intervals with respect to the central riser pipe 30 and the distributor 50 located thereover by dividing a space defined outside the central riser pipe 30 and the distributor 50. The distributor 50 located centrally is located at a position above the respective upper surface portions 48 of the refrigerant containers 40. Furthermore, a distribution hole 54 is laterally formed in a side portion or a lower side portion of the distributor 50 so as to be oriented toward each of the upper surface portions 48 of the refrigerant containers 40. In this embodiment, three refrigerant containers 40 are arranged at about 120 degree angular intervals, and also three distribution holes 54 are formed laterally. The distribution holes 54 serve to divide the cooling water to fall onto the respective refrigerant containers 40. To this end, separation ribs 34 (see FIG. 6) extend laterally from the central riser pipe 30 such that the distribution holes 54 and the respective upper surface portions 48 correspond to each other, thus defining arrangement positions of the refrigerant containers 40, and the distribution holes 54 are formed or disposed at positions between the separation ribs 34. If provision of the separation ribs 34 is not made, the upper surface portions 48 of the refrigerant containers 40 and the distribution holes 54 may not correspond to each other, and the cooling water discharged from the distribution holes 54 may fall directly between the refrigerant containers 40 without reaching the upper surface portions 48. Moreover, due to the fact that the cap portions 41 is provided on the upper surface portions 48 by protruding from the upper surface portions 48, the cooling water flowing down from the distribution holes 54 is changed in path by the cap portions 41 while laterally flowing on the upper surface portions 48, thus spreading evenly thereover.

Referring to FIG. 5, the flow of the cooling water flowing down from the distributor 50 onto the upper surface portions 48 and divided or changed in path by the cap portions 41 is indicated by an arrow. This cooling water can spread not only to the outer surface portions 43 of the refrigerant containers 40, but even to the side surface portions 46 and the inner surface portions 45. If the refrigerant containers 40 are integrally formed into a single cylindrical body, the cooling water only flows to an outer surface portion of the cylindrical body. However, in the case where the refrigerant containers 40 are provided with the inner surface portions 45 so as to define the vertical through-hole as in the present invention, it is possible that the cooling water undergoes heat exchange through the inner surface portions 45 during an upward flow and a downward flow. Furthermore, in the case where the multiple refrigerant containers 40 are provided in a separated type as in the present invention, it is possible that also the side surface portions 46 are utilized as heat exchange surfaces.

Figure 6:
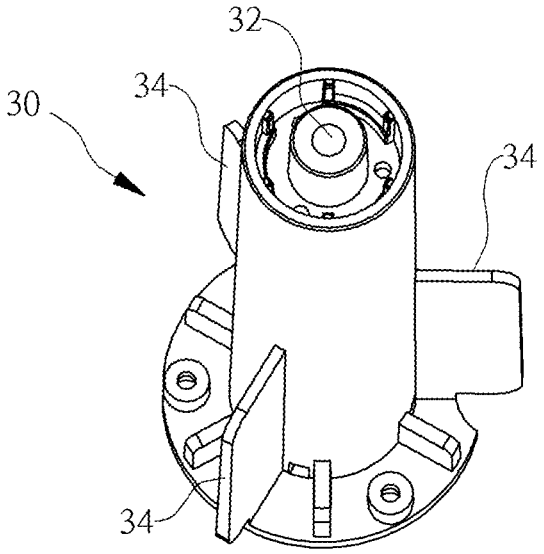
FIGS. 6 and 7 are views showing a central riser pipe and distributor according to the present invention.
Figure 7:
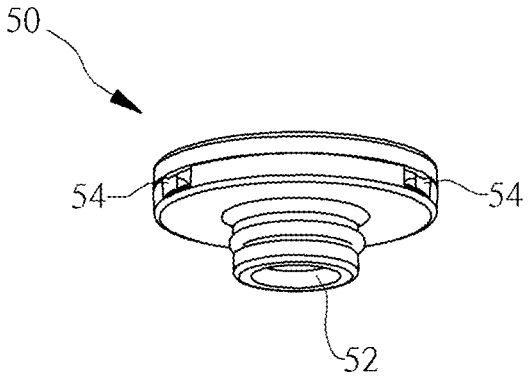

FIGS. 6 and 7 are views showing a central riser pipe and distributor according to the present invention. FIG. 6 shows the central riser pipe 30 vertically disposed inside the main body 20, and FIG. 7 shows the distributor 50 coupled to or provided at an upper end of the central riser pipe 30. The distributor 50 is shown in the figure as being a separate structure coupled to the upper end of the central riser pipe 30. However, the distributor 50 may be integrally formed at the upper end of the central riser pipe 30 as necessary.

The central riser pipe 30 has a vertical hole 32 formed therein and is disposed in an upward elongated shape. Three separation ribs extend laterally from the central riser pipe 30. This configuration is for defining the arrangement positions of the three refrigerant containers 40. The refrigerant containers 40 are arranged such that the side surface portions 46 are oriented toward the separation ribs 34 while the inner surface portions 45 are oriented toward the vertical hole 32. The three refrigerant containers 40 are arranged at 120 degree angular intervals in the drawings. However, two refrigerant containers 40 may be arranged at 180 degree angular intervals, or four refrigerant containers 40 may be arranged at 90 degree angular intervals. Meanwhile, the side surface portions 46 are spaced apart from each other by gaps defined therebetween by the separation ribs 34. These gaps increase the contact area with the cooling water.

The distributor 50 has a disc shape extending radially horizontally, with the distribution holes 54 being laterally formed in the side portions thereof. The cooling water introduced into a lower hole 52 of the distributor 50 flows laterally to be discharged through the distribution holes 54 and then flows down to the upper surface portions 48 of the refrigerant containers 40. The distribution holes 54 may be formed in the side portions of the distributor 50 as shown in the drawings, or may be formed in lower portions of the distributor 50 so as to directly face the upper surface portions 48 of the refrigerant containers 40.

Figure 8:
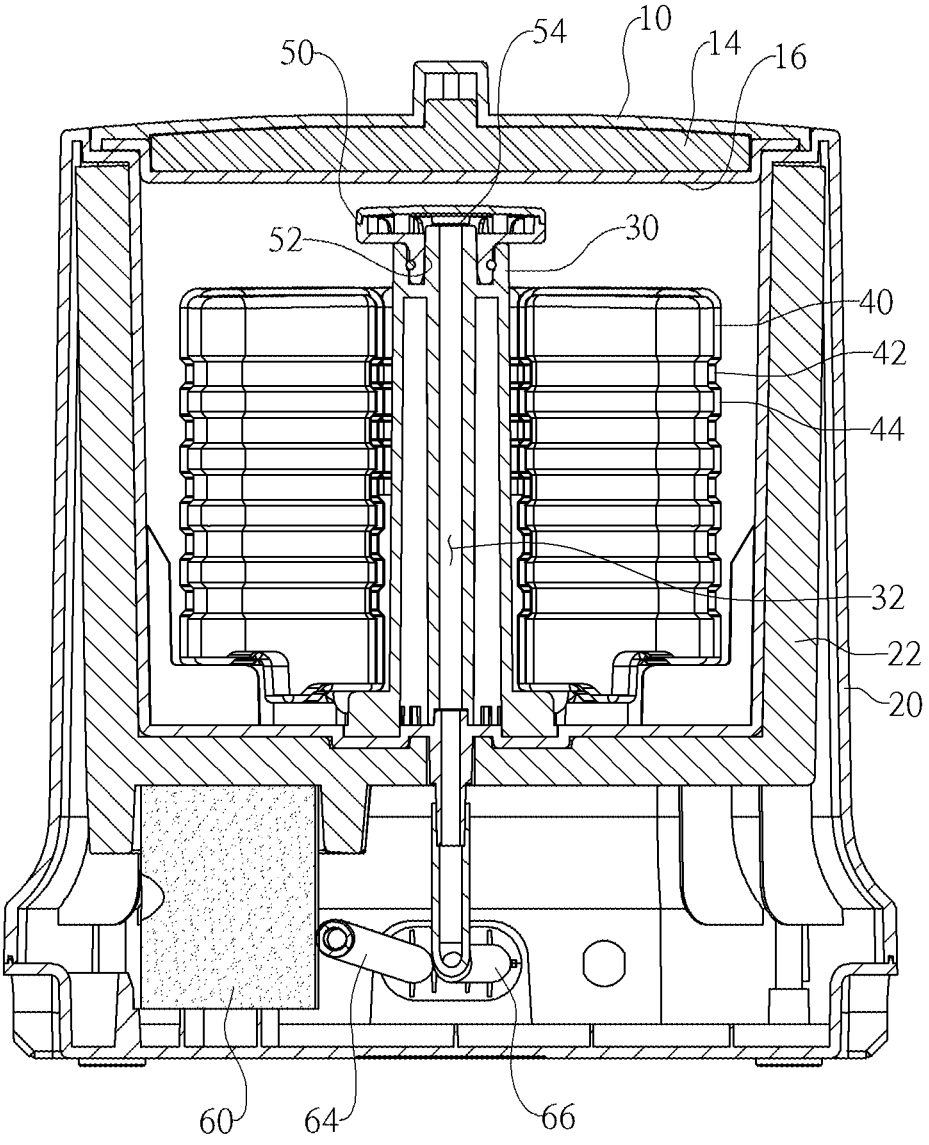
FIGS. 8 and 9 are sectional views showing the circulator for the cooling mat according to the present invention.
Figure 9:
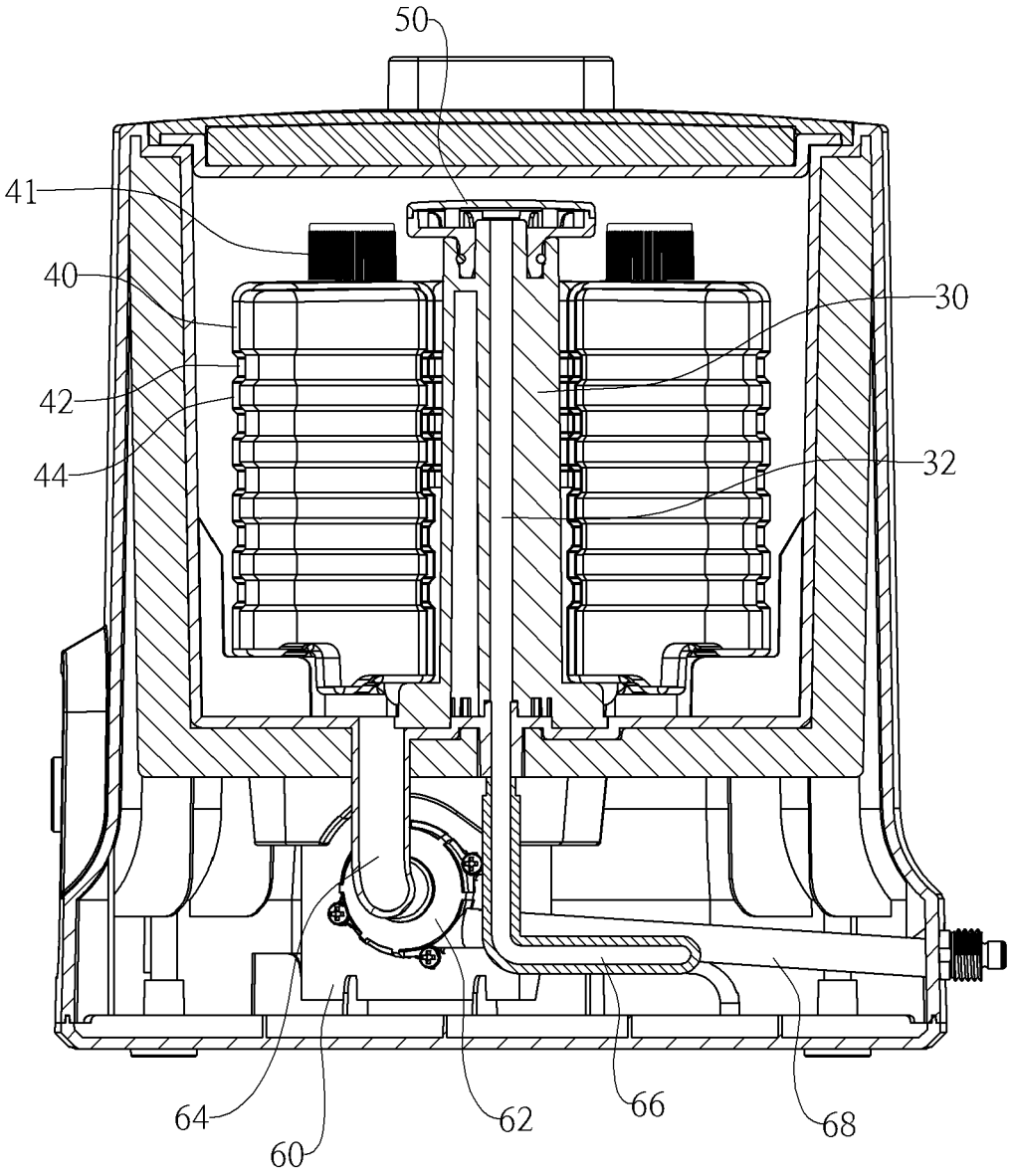

FIGS. 8 and 9 are sectional views showing the circulator for the cooling mat according to the present invention. Referring to FIG. 8, the buffer member 60, the recovery pipe 64, the inlet pipe 66, and the like are located in the circulation part of the main body 20, and the inlet pipe 66 communicates with the vertical hole 32 formed in the central riser pipe 30 located thereabove.

The cooling water recovered after being circulated inside the cooling mat is introduced into the inlet pipe 66 in a relatively warmed state and then pumped up along the vertical hole 32 of the central riser pipe 30 located above the inlet pipe 66. At this time, there is obtained an effect that the cooling water being pumped up undergoes primary cooling while facing the inner surface portions 45 of the refrigerant containers 40 disposed outside the circumference of the central riser pipe 30. The cooling water pumped up to the upper end of the central riser pipe 30 falls onto the upper surface portions 48 of the respective refrigerant containers 40 through the distributor 50.

The falling cooling water is divided by the cap portions 41 of the respective refrigerant containers 40 and undergoes secondary cooling while flowing down along the outer surface portions 43, the inner surface portions 45, and the side surface portions 46 through the upper surface portions 48. Here, multiple grooves 42 and multiple protrusions 44 are formed horizontally in parallel relation on an outer surface of each of the refrigerant containers 40, thus forming an increased surface area which is in contact with the cooling water flowing along the inner wall of the main body 20, and extending the time the cooling water stays in the main body 20.

Referring to FIG. 9, the motor 62 located in the circulation part is configured such that vibrations and noises generated thereby are reduced by the buffer member 60 surrounding upper and lower sides of the motor 62. The cooling water flowing down in contact with the refrigerant containers 40 flows down through the recovery pipe 64, and the hydraulic pressure and water flow rate are generated by the motor 62, causing the cooling water to be discharged to the cooling mat through the discharge pipe 68. The cooling water accumulated in the cooling part exchanges heat with the inner surface portions 45 of the multiple refrigerant containers 40 and with the side surface portions 46, as well as with the outer surface portions 43 having the increased surface area.

In addition, due to the fact that the central riser pipe 30 is centrally disposed inside the cooling part of the main body 20 and the central riser pipe 30 is surrounded by the refrigerant containers 40, it is possible to obtain an effect that the recovered cooling water is primarily cooled while being pumped up along the vertical hole 32.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A circulator for a cooling mat, the circulator comprising:

a main body including a cooling part having a structure for cooling a fluid by heat exchange, and a circulation part located under the cooling part and having a structure for circulating the fluid;

a lid covering an upper end opening of the cooling part of the main body;

a refrigerant container located inside the cooling part and accommodating a refrigerant therein;

a recovery pipe recovering the fluid after the fluid is brought into contact with the refrigerant container;

a motor disposed inside the circulation part to circulate the fluid that is introduced from the recovery pipe;

a discharge pipe discharging the cooled fluid to the cooling mat; and an inlet pipe into which the fluid to be returned after circulation inside the cooling mat is introduced, wherein the fluid introduced into the cooling part from the inlet pipe flows in contact with the refrigerant container located inside the cooling part, wherein a central riser pipe extending upward is centrally disposed inside the cooling part, and a vertical hole is formed in the central riser pipe in communication with the inlet pipe, such that the fluid introduced into the inlet pipe is pumped up to an upper end of the central riser pipe along the vertical hole, and wherein the refrigerant container located inside the cooling part is provided as multiple refrigerant containers, and the refrigerant containers are arranged outside a circumference of the central riser pipe in close contact therewith, such that heat exchange occurs between the fluid pumped up along the vertical hole of the central riser pipe and the refrigerant accommodated in the refrigerant containers.

2. The circulator of claim 1, wherein the central riser pipe includes separation ribs extending laterally therefrom at a regular interval to separate a space, and the refrigerant containers are arranged outside the circumference of the central riser pipe in close contact therewith, with predetermined gaps defined between the refrigerant containers by the separation ribs.

3. The circulator of claim 2, wherein a distributor is provided at the upper end of the central riser pipe, and the distributor includes:

a lower hole communicating with the vertical hole of the central riser pipe; and a distribution hole formed laterally outwardly to radially discharge the fluid introduced through the lower hole to outside the distributor.

4. The circulator of claim 3, wherein the distribution hole of the distributor is provided as multiple distribution holes such that the distribution holes correspond to the respective refrigerant containers arranged outside the circumference of the central riser pipe, and the distribution holes are oriented toward respective upper surface portions of the refrigerant containers or are formed at positions above the upper surface portions, such that the fluid passing through the distributor falls onto the upper surface portions of the refrigerant containers while being discharged through the distribution holes.

5. The circulator of claim 4, wherein each of the refrigerant containers includes a cap portion protruding from each of the upper surface portions thereof, and the respective cap portions are located outside lower ends of the distribution holes, such that the fluid falling from the distribution holes is changed in path by the cap portions while flowing outwardly.

6. The circulator of claim 5, wherein each of the refrigerant containers includes:

an outer surface portion oriented toward an inner wall of the main body located away from the central riser pipe;

an inner surface portion facing toward the central riser pipe at a position close thereto; and side surface portions connecting the outer surface portion and the inner surface portion to each other, wherein the fluid changed in the path by each of the cap portions flows down in contact with at least one of the outer surface portion, the inner surface portion, and the side surface portions.

7. The circulator of claim 6, wherein multiple grooves and multiple protrusions are formed horizontally on the at least one of the outer surface portion, the inner surface portion, and the side surface portion.

* * * * *